US010926375B2

(12) United States Patent
Laforest et al.

(10) Patent No.: US 10,926,375 B2
(45) Date of Patent: Feb. 23, 2021

(54) PRESSURE-FIT GRINDING PAD ASSEMBLY AND METHOD OF CONSTRUCTION

(71) Applicant: GESTION ANNY PICARD INC., Blainville (CA)

(72) Inventors: Luc Laforest, Ste Therèse (CA); Mario Fréchette, Saint-Hyppolyte (CA); Sébastien Fortin, Saint-Jérome (CA)

(73) Assignee: GESTION ANNY PICARD INC., Blainville (CA)

( * ) Notice: Subject to any disclaimer, the term of this patent is extended or adjusted under 35 U.S.C. 154(b) by 339 days.

(21) Appl. No.: 15/998,051

(22) Filed: Jun. 20, 2018

(65) Prior Publication Data

US 2019/0389034 A1 Dec. 26, 2019

(51) Int. Cl.
*B24B 45/00* (2006.01)
*B24B 7/18* (2006.01)

(52) U.S. Cl.
CPC ..... *B24B 45/006* (2013.01); *B24B 7/186* (2013.01)

(58) Field of Classification Search
CPC ..... B24B 45/006; B24B 7/186; B24B 41/047; B24B 7/066
See application file for complete search history.

(56) References Cited

U.S. PATENT DOCUMENTS 3,121,982 A 2/1964 Miller
4,109,737 A 8/1978 Bovenkirk
5,070,656 A 12/1991 Brogden
5,076,023 A 12/1991 Saguchi
5,567,503 A 10/1996 Sexton et al.
5,586,930 A * 12/1996 Hayashi ..... B24B 7/22 451/548
7,137,875 B2 11/2006 Jeansson
7,147,548 B1 12/2006 Mehrabi
7,192,339 B1 3/2007 Harding
7,506,644 B2 3/2009 Park
7,670,208 B2 3/2010 Thysell et al.
7,997,960 B2 8/2011 Williams, Sr.
8,251,780 B2 8/2012 Ward
8,464,420 B2 6/2013 Ye
2006/0025059 A1 2/2006 Gueorguiev et al.
(Continued)

FOREIGN PATENT DOCUMENTS

EP 0916804 5/1999
WO WO2017009524 9/2017

*Primary Examiner* — Dung Van Nguyen
(74) *Attorney, Agent, or Firm* — Guy J. Houle; Houle Patent Agency Inc.

(57) ABSTRACT

A pressure-fit grinding pad assembly and a method of constructing same and connection to a grinding pad of a floor grinding machine or other suitable type grinding machines is described. The grinding pad is formed by an abrasion head of abrasion material which is immovably bonded on a metal attachment base which is shaped for pressure fit connection to a mounting base and wherein its removal therefrom requires it to be pressure punched with adequate force. The mounting base can be a steel plate shaped for connection to retainers secured to or formed in an outer surface of a grinding disc or may be constituted by holes formed in the top surface of the grinding disc. The mounting base can be formed integrally with the attachment base of the grinding pad for connection to the retainers.

17 Claims, 9 Drawing Sheets

(56) References Cited

U.S. PATENT DOCUMENTS

| | | | | |
|---|---|---|---|---|
| 2006/0116060 | A1* | 6/2006 | Thysell | B24B 7/186 451/548 |
| 2008/0009232 | A1* | 1/2008 | Thysell | B24B 7/186 451/548 |
| 2008/0176498 | A1 | 7/2008 | Rossi et al. | |
| 2010/0136889 | A1 | 6/2010 | Thysell et al. | |
| 2012/0270483 | A1* | 10/2012 | Bae | B24B 7/186 451/540 |
| 2013/0029569 | A1 | 1/2013 | Van Eijden et al. | |

* cited by examiner

PRESSURE-FIT GRINDING PAD ASSEMBLY AND METHOD OF CONSTRUCTION

FIELD OF THE INVENTION

The present invention relates to grinding machines and more particularly to grinding disc constructions and grinding pads adapted to be removably connected to the grinding disc of such machines for grinding concrete surfaces or like hard surfaces to form a smooth surface.

BACKGROUND OF THE INVENTION

Grinding machines of many type of construction are known wherein abrasive pads are secured to one or more motor driven grinding disc to abrade and polish hard surfaces such as concrete surfaces, stone surfaces such as granite, marble, ceramic or any hard surface material where a smooth surface finish or polish finish is required. These abrasive pads contain abrasive particles such as diamond, silicon carbide and other wear resistant particles which are bonded in a carrier such as by sintered bond, electroplate bond, vacuum brazed, epoxy and resin materials and other such suitable hard bonding materials.

In one known abrasive pad construction these abrasive pads are formed in many shapes and these pads are braised onto an outer surface of a wedge-shaped steel support of sufficient thickness to form a strong bond with the pads. These supports are removably connected to a motor driven grinding disc and firmly held in place by wedging and the centrifugal force provided by the rotational speed of the disc. There are usually two of such abrasive pads braised to a steel mounting base support in close proximity to one another. Because the braising operation is time consuming, usually taking about five minutes or more to braise two of such pad on a base, and somewhat delicate due to the small size of the pads and their close proximity to one another, such operation as proven costly. The operation consists of securing the steel base in a vise with flux material applied over the top surface of the base. The worker then has to place braising material, herein small silver strips, at precise positions on the base and then dispose the abrasion pads over the braising material. The steel base is then heated with a torch from underneath until the base and pads becomes red hot and reaches a temperature sufficient to melt the braising material and at which point the operator must carefully re-align the pads in position on the melted silver. The steel base then has to cool and the flux material removed from the surface of the base.

One disadvantage of this braising process is that the intense heat applied to the abrasive pads reduces the life of the pads for the reason that the hard abrasive chips, such as diamond chips, become graphitized causing the external surface of the pads to break up faster when in use with the weight of the machine resting thereon. Also if the assembly is not properly made such as improper amount of braising material being applied, there is the risk that the pad could distort or disconnect during a floor grinding operation particularly if the floor surface has different hardness and non-smooth areas. Another disadvantage is the shape of the pad, for example rectangular or wedge shape, which can render the braising operation more difficult and time consuming. Accordingly, such pad construction is costly and prone to failure if not properly constructed. Further, recycling the base is not practical and too time consuming due to the fact that metal fragments remain on the top surface of the base requiring grinding.

There is therefore a need to overcome such grinding pad assembly problems by providing a fabrication method which is less time consuming and not dependent on a braising process for connecting grinding pads to an attachment base or disc. There is also a need to provide a grinding pad assembly wherein pads can have different shapes of abrading heads and mounted on a common support base and further wherein a single motor driven support disc can be fabricated to receive desired numbers of grinding pad assemblies and permit different pad configurations on the grinding disc. There is also a need to provide grinding pads which are quickly replaceable by a user person without the need to purchase pads assembled to a support base. A further need is to provide grinding pad assemblies which overcome substantially all of the disadvantages of the above mentioned prior art.

SUMMARY OF THE INVENTION

It is a feature of the present invention to provide a pressure-fit grinding pad assembly which substantially overcomes the above mentioned disadvantages of a known pad construction and provide for the desired needs mentioned herein above.

Another feature of the present invention is to provide a pressure-fit grinding pad assembly wherein the grinding pad is immovably secured to an attachment base by a press to prevent removal or accidental disconnection of the pad and wherein disconnection of its attachment base is made only by the application of a suitable pressure punching force.

A further feature of the present invention is to provide a pressure-fit grinding pad for removable securement in selected ones of holes provided in a high speed rotatable grinding disc of a floor grinding machine.

A still further feature of the present invention is to provide a grinding pad assembly which is removably secured in selected ones of a plurality of cavities formed about a circumferential axis of a grinding disc and held secured therein by friction and the centrifugal force of the grinding disc when rotatably driven.

Another feature of the present invention is to provide a method of constructing a grinding head of a floor grinding disc assembly which overcomes the above mentioned disadvantages and which does not use a braising method.

A further feature of the present invention is to provide a novel grinding pad wherein the mounting base of the abrasion head is formed as to provide removable engagement into attachment means of a grinding disc.

According to the above features, from a broad aspect, the present invention provides a pressure-fit grinding pad assembly which is comprised of a mounting base having one or more through bores extending from a top surface of the mounting base to a bottom surface thereof. The through bores each have an inner surface of defined cross-sectional shape extending between the top surface to the bottom surface. A grinding pad is formed by an abrasion head of abrasion material immovably bonded on a metal attachment base also having a defined cross-sectional shape dimensioned for pressure fit connection into the the inner surface of the mounting base by the use of a press exerting a pressure sufficient to fully engage the attachment metal base in the through bore to prevent removal of the attachment base from its securement therein without the use of pressure punching the attachment base from the through bore. The abrasion head also projects above the top surface of the mounting base.

According to another broad aspect of the invention there is provided a pressure-fit grinding pad for removable securement in a high speed rotatable grinding disc of a floor grinding machine. It comprises a circular grinding disc having a plurality of through bores extending from a top surface of the grinding disc to a bottom surface thereof. Each of the through bores has a common inner cross-sectional surface disposed between the top surface to the bottom surface of the grinding disc. A grinding pad is formed by an abrasion head of abrasion material immovably bonded on a metal attachment base having a defined cross-sectional shape dimensioned for pressure fit connection in selected ones of the through bores by the use of a press. The press exerts a pressure sufficient to fully engage the attachment metal base in the through bore to prevent removal of the attachment base from its securement therein without the use of pressure punching the attachment base from the through bore. The abrasion head projects above the top surface of the grinding disc.

According to a still further broad aspect of the present invention there is provided a pressure-fit grinding pad assembly for removable securement to a high speed rotatable grinding disc. The grinding pad assembly comprises an abrasion head bonded onto a mounting base. The disc is a circular flat grinding disc having a plurality of grinding pad engaging cavities formed in an outer surface thereof and disposed spaced apart along a circumferential axis of the grinding disc. The grinding pad engaging cavity is in the form of an open top end cavity having a grinding pad receiving end section and a grinding pad engaging section for receiving the mounting base of the grinding pad in engagement therein and with the grinding pad abrasion head projecting above the outer surface of the grinding disc.

According to another broad aspect of the present invention there is provided a grinding pad comprised of an abrasion head section of abrasion material immovably mounted onto a metal mounting base section. The mounting base section has at least sections thereof provided with connecting formations shaped to define engagement means for securing the grinding pad in attachment means of a motor driven grinding disc of a floor grinding machine.

According to another broad aspect of the invention there is also provided a method of constructing a grinding disc for use with a floor grinding machine. The method comprises the steps of:

i) forming a grinding pad by immovably bonding an abrasion head formed of abrasion material to a metal attachment base, and ii) pressure-fit connecting the metal attachment base to coupling means associated with the grinding disc, and wherein the pressure fit is performed by the use of sufficient pressure to prevent removal of the attachment base from the coupling means without the use of pressure punching the attachment base from the coupling means.

In the method, the coupling means is a metal mounting base, and wherein the step (i) of forming the grinding pad comprises boring one or more through bores of predetermined cross-section in the metal mounting base. The mounting base bottom surface is a flat bottom surface. The step (ii) comprises pressure fit connecting the metal attachment base of the grinding pad in one of the said one or more through bores with the abrasion head projecting above the top surface of the mounting base by the use of the press exerting sufficient pressure to prevent removal of the metal attachment base without the use of pressure punching the metal attachment base from the through bore.

Also in the method, the coupling means is constituted by a plurality of grinding pad engaging cavities formed in an outer surface of a single flat grinding disc and disposed spaced apart along a circumferential axis of the flat grinding disc. The grinding pad engaging cavity is an open-top-end cavity having a grinding pad receiving end section and a grinding pad engaging section. The step (ii) comprises positioning the metal attachment base of the grinding pad in the grinding pad receiving end section and displacing the metal attachment base into the grinding pad engaging section for connecting the grinding pad to the flat grinding disc with the abrasion head projecting above the outer surface of the flat grinding disc.

Still further in the method each of the retention means is a mounting base engaging cavity defining a mounting base receiving end section and a mounting base engaging section of wedge-shaped configuration defining opposed inwardly tapered side walls. The step (ii) is comprised by positioning the metal mounting base of the grinding pad assembly in the mounting base receiving end section with the attachment means aligned with the mounting base engaging section and displacing the grinding pad assembly to cause the sloping opposed side surfaces of the metal mounting base to wedge under the opposed inwardly tapered side walls of the mounting base engaging section of the mounting base engaging cavity.

BRIEF DESCRIPTION OF THE DRAWINGS

A preferred embodiment of the present invention will now be described with reference to examples thereof as illustrated in the accompanying drawings in which.

DETAILED DESCRIPTION OF THE INVENTION

Figure 1:
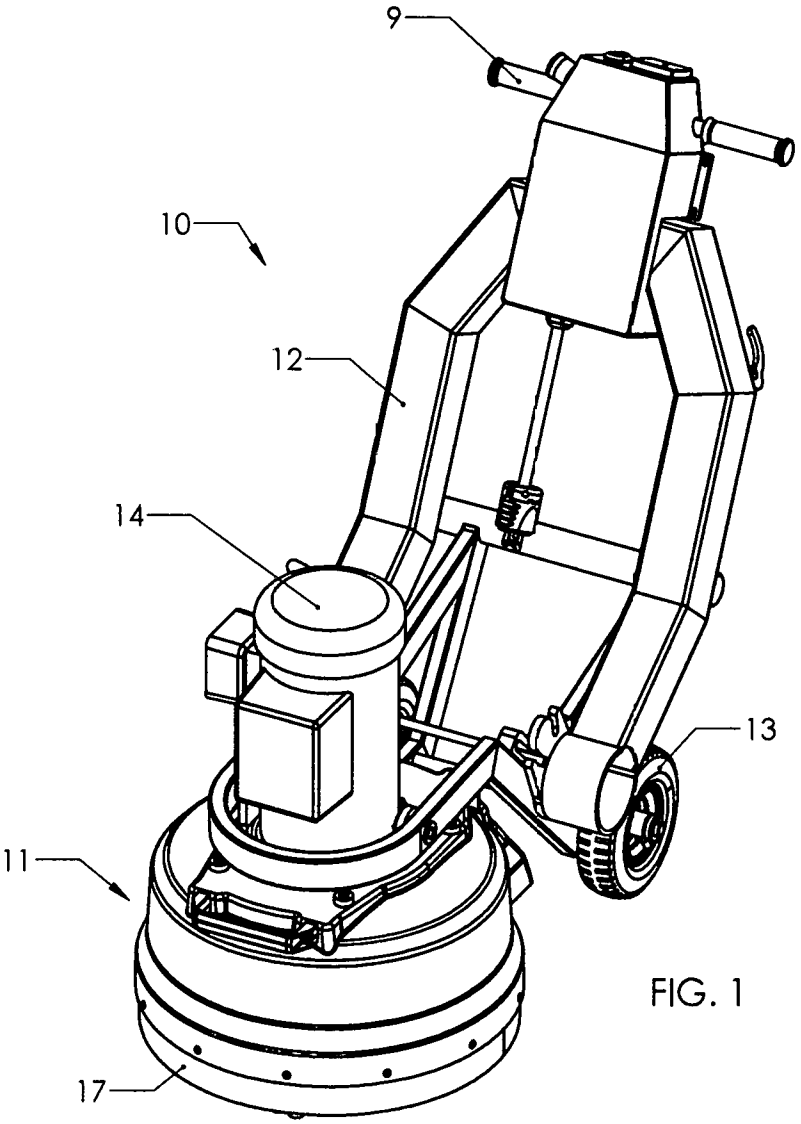
FIG. 1 is a perspective view of a typical type of floor grinding machine capable of being fitted with grinding discs equipped with pressure-fit grinding pads of the present invention.
Figure 2:
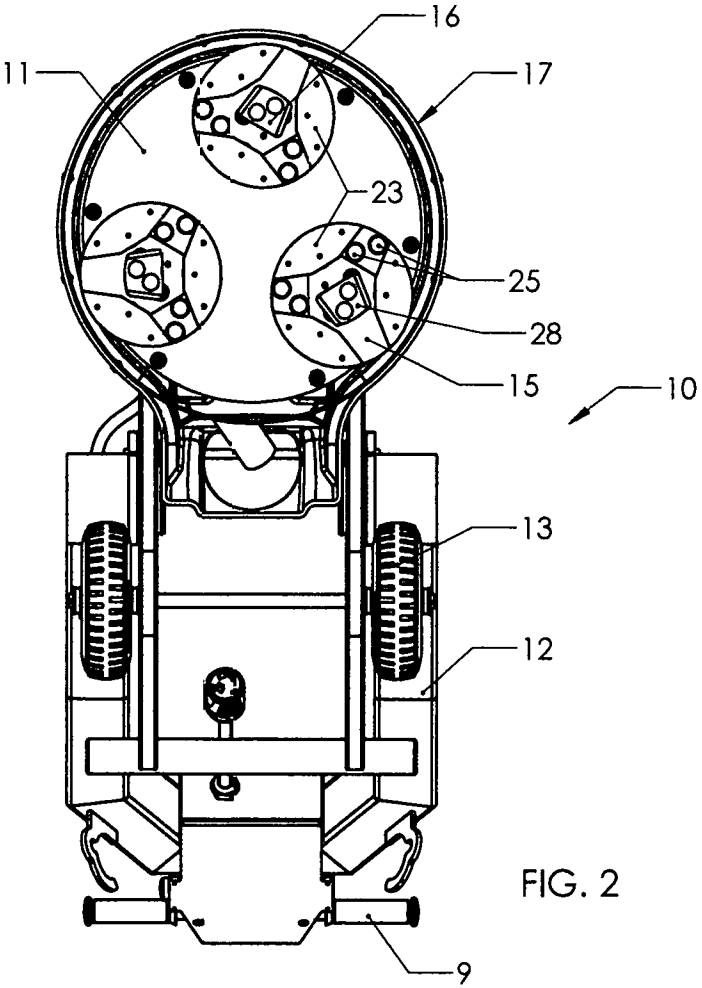
FIG. 2 is a bottom view of the floor grinding machine of FIG. 1 showing three grinding discs equipped with the pressure-fit grinding pad assemblies of the present invention.

Referring now to the drawings, and more particularly to FIGS. 1 and 2, there is shown generally at 10 a typical floor grinding machine which is comprised of a grinding head assembly 11 which is displaced by a framework 12 mounted on a wheel assembly 13. A pair of handles 14 is connected to the framework for a user person to displace the grinding head assembly 11 over a floor surface constructed of concrete, stone or other such hard materials. The head assembly is provided with an annular protective skirt 17 to permit, by the use of a vacuum, the removal of dust particles which can cause nausea to the user person when grinding concrete surfaces. The head assembly 11 has a motor 14 mounted thereon to impart rotation to one or more grinding discs, herein three grinding discs 15, by drive coupling means, not shown but obvious to a person skilled in the art. Such drive coupling means may consist of various linkage arrangements which do not form part of the present invention. The motor and drive linkages constituting the head assembly provides weight onto the grinding discs 15. Has shown in FIG. 2, the grinding discs are equipped with press-fit grinding pad assemblies 16 constructed in accordance with one example of the present invention.

Figure 3:
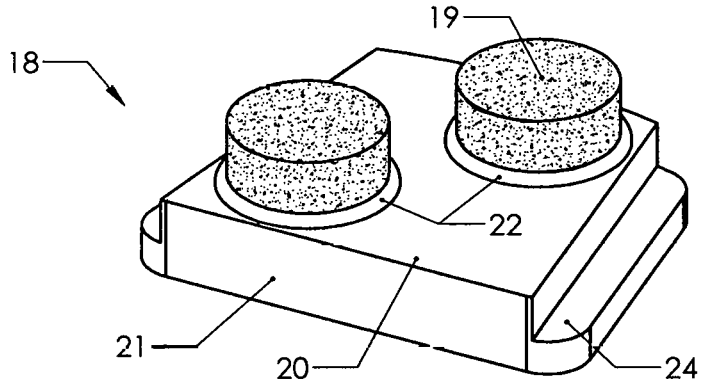
FIG. 3 (PRIOR ART)
FIG. 3 is a perspective view of a grinding pad assembly constructed in accordance with the prior art and wherein the grinding pads in disc form are braised on the top surface of a steel attachment wedge-shaped base.

Referring to FIG. 3 there is shown a grinding pad assembly 18 constructed in accordance with the prior art and wherein two grinding pads 19, herein in the form of a circular discs but they could have any suitable form, are braised directly on a flat top surface 20 of a wedge-shaped steel plate which forms a mounting base 21. Has herein shown, braising silver material 22 is use to heat braise the grinding pads 19 to the mounting base 21 and silver deposits can be seen fused about the base of the pads 19. The mounting base is machined to form connecting flanges 24 on opposed sides thereof for retention engagement between the retainer plates 23 secured to the outer face of the grinding discs 15. The many disadvantages of such grinding pad assembly 18 has been described herein above.

Figure 4A:
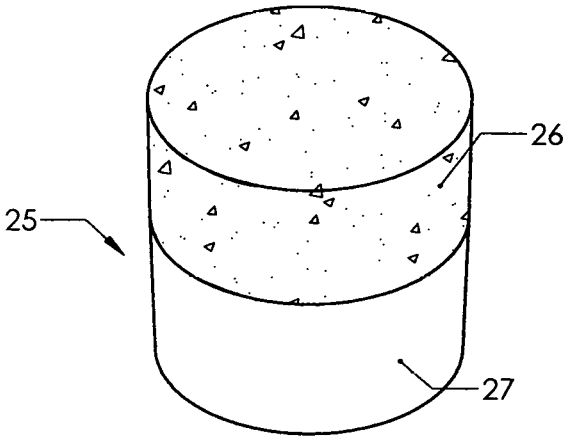
FIG. 4A is a perspective view of the construction of the grinding pad used in the grinding pad assembly of the present invention and wherein the pad is formed with an abrasion head bonded to a steel attachment base.

The present invention overcomes the problems of the prior art grinding pad assembly 18 of FIG. 3 as illustrated by FIGS. 4A to 7. As shown in FIGS. 4A and 4B, the grinding pad 25 of the present invention is formed in two parts, namely an abrasion head 26 of abrasion material which is bonded on a metal attachment base 27. The abrasion head 26 is herein shown as a circular disc but it may have other forms such as rectangular shape, wedge shape, diamond shape, etc. bonded on top of the attachment base 27. The abrasion head can also have abrasion material of a specific grit count as desired for grinding different hard surface materials. The attachment base 27 is herein shown as having a circular cross-section but it can also have a different cross-sectional shape for reasons as will be described herein. As shown the attachment base 27 is also formed with a slight inward conical taper 27' for ease of connection in holes or bores formed in the mounting base 28 of FIG. 7.

Figure 5:
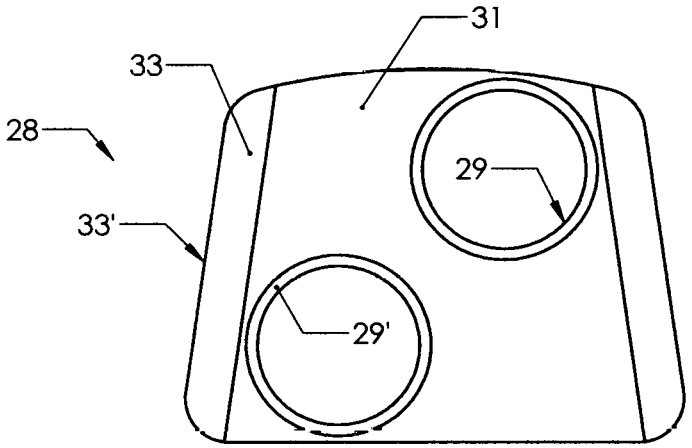
FIG. 5 is a top view of the wedge shaped metal mounting base constructed to receive pressure-fit grinding pads of the invention and illustrating, in an exaggerated form, the tapered through bores formed in the mounting base.
Figure 7:
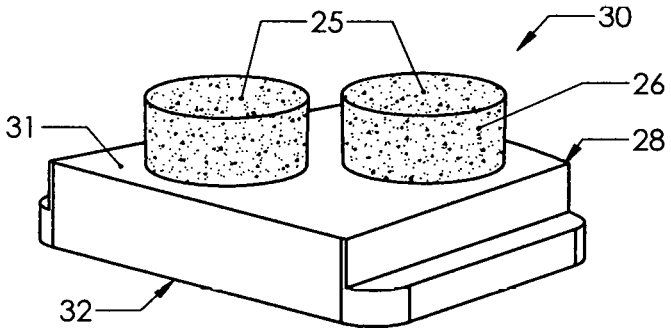
FIG. 7 is a perspective view of the assembled pressure fit grinding pad assembly constructed in accordance with an embodiment of the present invention.
Figure 6:
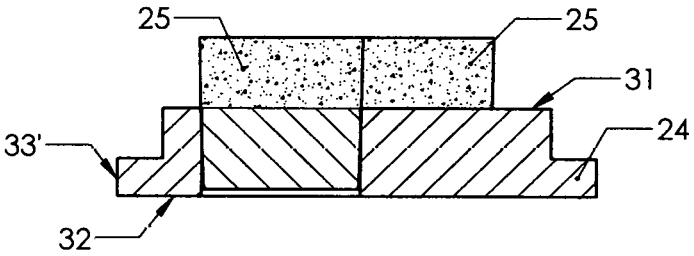
FIG. 6 is a cross-sectional view of the grinding pad assembly and wherein the grinding pad is shown press fitted into the metal mounting base and wherein there are no braising material deposits deposit formed about the grinding pad.

As shown in FIGS. 5 to 7, the mounting base 28 is constructed similar to the base 21 of FIG. 3, with the exception that two through bores 29 are formed in the steel base to receive in pressure-fit therein the attachment base 27 of the grinding pad 25. The through bores 29 extend from a flat top surface 31 to a flat bottom surface 32 of the mounting base 28 Also, the mounting base is of wedge shape, similar to FIG. 3, and formed with connecting flanges 33 and these constitutes attachment means. The through bores 29 can also be formed with a complimentary tapered inner surface 29', in the range of 5 to 10 degrees, complimentary to the conical shaped of the attachment base 27 of the pad, to facilitate the press-fit assembly of the pad therein. It is pointed out that to secure the grinding pads 25 into the through bores 29, the mounting base 28 of the pads 25 positioned over their respective bores, and disposed on a press which is capable of exerting a pressure of about 250 psi or more and the press is actuated to press the pads into the through bores as illustrated by FIG. 6. Accordingly, this pressure-fit engagement prevents the pads from being accidently dislodged during use but more importantly reduces manufacturing costs, is less hazardous to fabricate, and not prone to errors in its assembly. Also, after the abrasion head 26 is worn out replacement pads can be secured in the mounting base 28 by the use of pressure punching the attachment base 27 from its press fit connection in the through bore 29 and installing new grinding pads 25 by the use of a press.

It is to be noted that several mounting bases 28 with pads 25 positioned thereon can be press fitted at the same time in a single operation. Such technique greatly reduces assembly time as compared to the assembly of the prior art, as shown in FIG. 3, grinding pad assembly 18 of the prior art wherein each grinding pad assembly is individually manufactured by a time consuming process and subjected to errors in its fabrication. Further, with the present invention, a user person of the floor grinding machine can attend to the replacement of grinding pads from the grinding discs of its floor grinding machine resulting in a cost saving to the user person by not having to purchase pad assemblies.

Figure 8A:
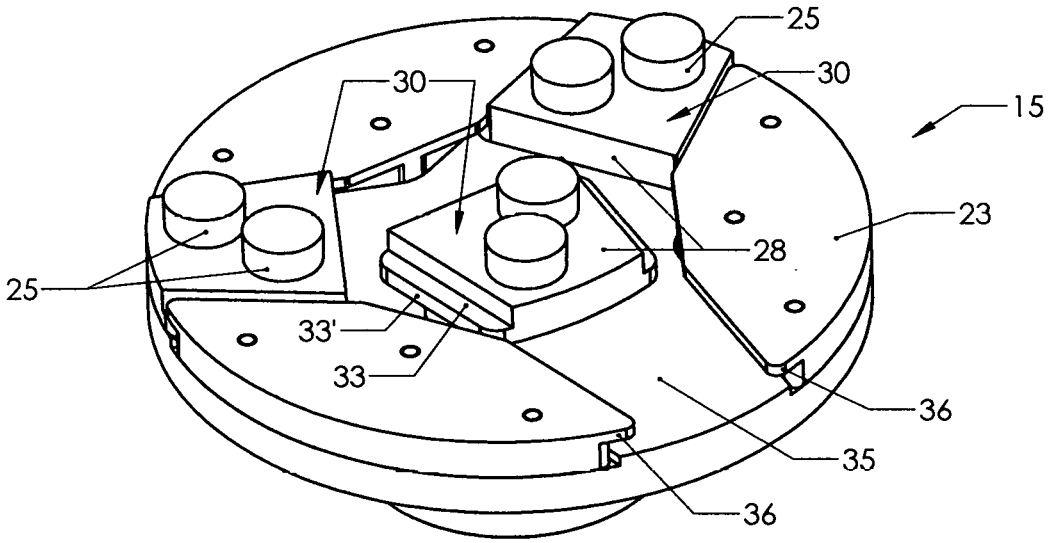
FIG. 8A is a perspective view of a grinding disc showing the grinding pad assembly, of FIG. 7, and illustrating how the pressure fit grinding pad assembly is secured to the disc.
Figure 8B:
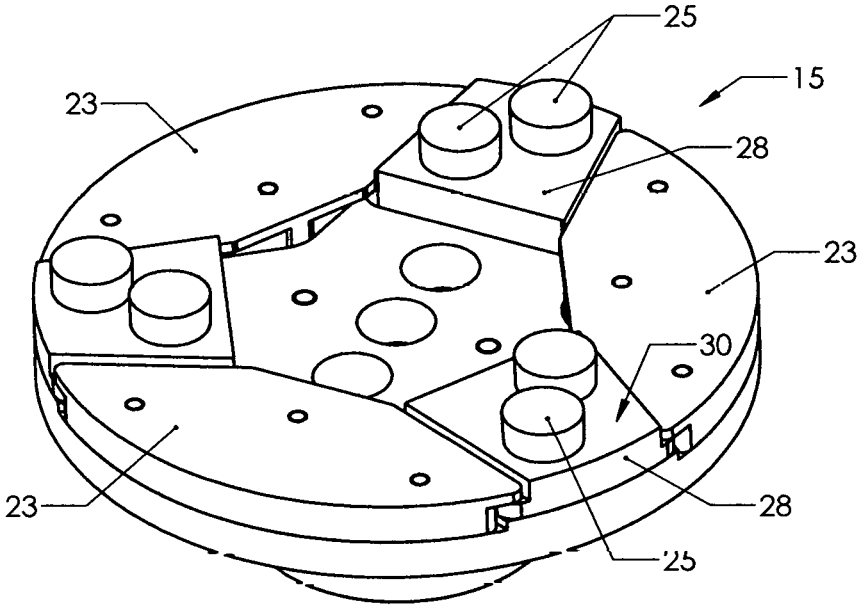
FIG. 8B is a perspective view similar to FIG. 8A showing all three grinding pad assemblies at a secured position.
Figure 9A:
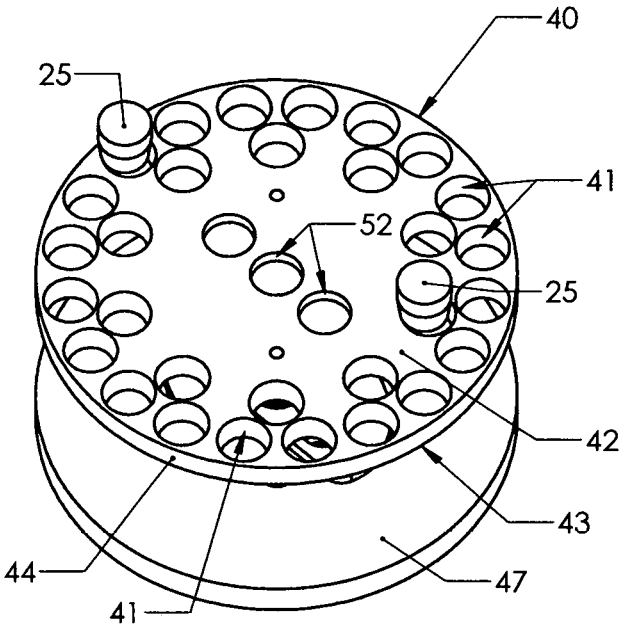
FIG. 9A is a perspective view of another embodiment wherein a single motor driven support disc assembly is provided and wherein a detachable grinding disc is formed with a plurality of engaging cavities for receiving in pressure-fit, in selected ones of the cavities, the grinding pad of FIGS. 4A and 4B, and as herein illustrated, the grinding disc is shown detached from its support disc to permit it to be used in a press to immovable pressure fit grinding pads in selected ones of the cavities.
Figure 9B:
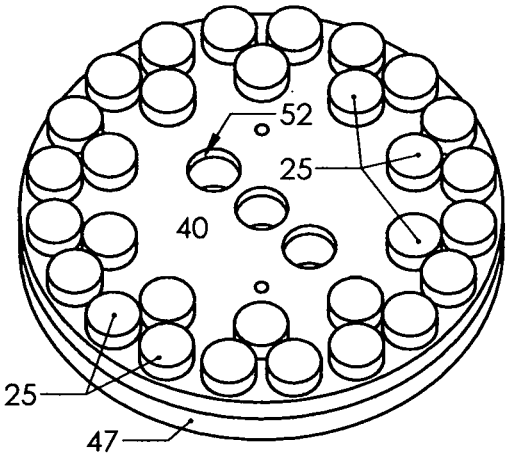
FIG. 9B is a perspective view of the support disc assembly of FIG. 9A with grinding pads of the present invention shown pressure-fit connected in two circumferential rows of engaging cavities
Figure 10:
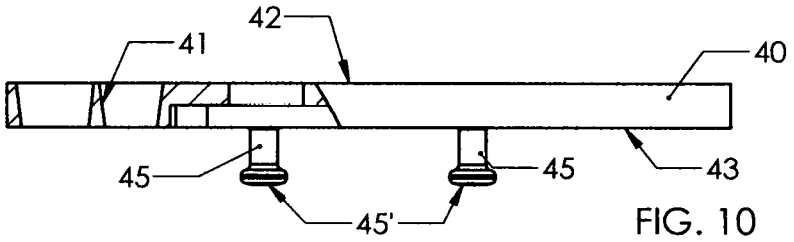
FIG. 10 is a fragmented side view showing the construction of the detachable grinding disc.
Figure 11:
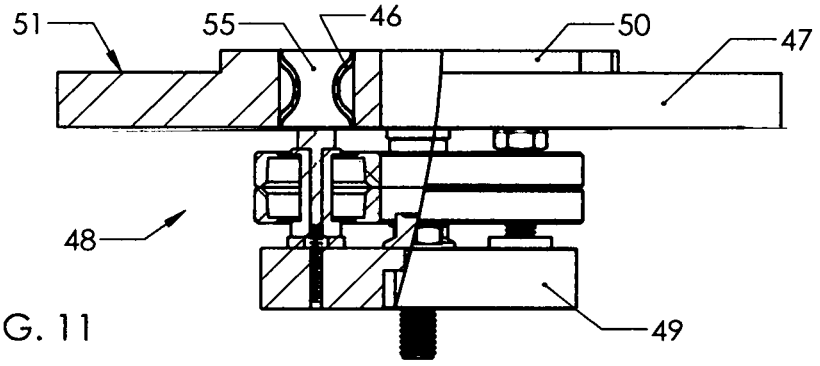
FIG. 11 is a fragmented view showing the basic parts of the motor driven detachable disc assembly.

FIG. 7 illustrates the assembled pressure fit grinding pad assembly 30 constructed in accordance with FIGS. 4A to 6 and FIGS. 8A and 8B illustrates how these pad assemblies are secured to the grinding discs 15 of the floor grinding machine 10 illustrated in FIGS. 1 and 2. The retainer plates 23 are secured spaced-apart on the flat top surface 34 of the grinding disc 15 and define between spaced side edges thereof open top end wedge shaped cavities 35 to receive in friction fit therein the mounting bases 28 of the grinding pad assembly 30. Their side edges are also formed with a top projecting flange 36 to project in friction fit over the connecting flanges 33 of the mounting base 28. As shown in FIG. 8A, two grinding pad assemblies 30 are shown in secured position while the pad assembly 30' is shown at a position prior to being inserted into the vacant open top end cavity 35. The connecting flanges 33 have wedge shaped straight side surfaces 33' for friction fit engagement with the side walls of the cavities 35 for frictional engagement therein. Also, during use, the centrifugal force generated by the high speed rotation of the disc 15 maintains the grinding pad assemblies 30 firmly engaged in their respective open top end cavities 35, as shown in FIG. 8B.

Figure 4B:
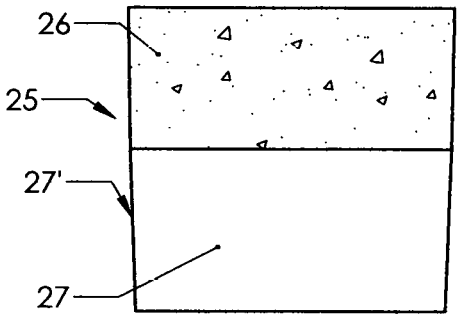
FIG. 4B is a side view of FIG. 4A.

With reference now to FIGS. 9A to 11, there is illustrated another example of the construction of the pressure-fit grinding pad assembly wherein the grinding pad 25 of FIGS. 4A and 4B is secured in a mounting base which is herein constituted by a grinding disc 40 which is provided with a plurality of through bores 41 extending from a top surface 42 thereof to a bottom surface 43. Each bore 41 is formed with a common inner cross sectional surface dimensioned to receive the attachment base 27 of the grinding pad 25 in friction fit therein by the use of a press exerting a pressure as mentioned herein above to firmly engage the pad and permit removal of the attachment base of the pad only by the use of a punching pressure with sufficient force to detach the base from the disc 40. The through bores 41 may have a slight conical taper as well as the attachment base to facilitate mating the attachment base with a selected one of the through bores 41, as described above with respect to the other embodiment. As herein illustrated, through bores 41 are formed along two circumferential paths of the grinding disc 40 adjacent the outer edge 44 thereof. FIG. 9B shows grinding pads 25 secured in all through bores 41 of the disc 40. In practice a floor grinding machine operator will secure or have secured grinding pads in selected ones only of the through bores. The operator may also mount grinding pads having different abrasion head shapes or may equip a few of the grinding discs 40 with grinding pads having different grit counts, for example 16 grit or 20 grit, for quick interchange, depending on the surface to grind.

The grinding disc 40 is also provided with connectors projecting from the bottom surface 43 for quick connection under the head assembly 11, herein provided by two spaced-apart connector pins 45. The connector pins 45 are formed with an engaging head which is configured for clamping engagement by spring connectors 46 secured in matting holes 55 of a support disc 47. The support disc 47 has a circumference substantially the same as that of the circular grinding disc 40. The support disc 47 is coupled to a rotatable drive platform 49 through a flexible connecting assembly 48 whereby the grinding disc 40 and its grinding pads 25 can pivot over floor surface irregularities. Such is well known in the art. A spacing stabilizing support plate 50 or formation is provided on the top face 51 of the support disc 47 to abut the bottom surface 43 of the grinding disc 40 to retain the grinding disc 40 parallel to the support disc 47 to prevent the transfer of shearing forces forces to the connector pins 45 cause by any unstable and shaky movement of the grinding disc 40 during rotational drive thereof by the motor of the floor grinding machine. The holes 52 in the central area of the grinding disc 40 permits access to fasteners there under and not shown.

Figure 12A:
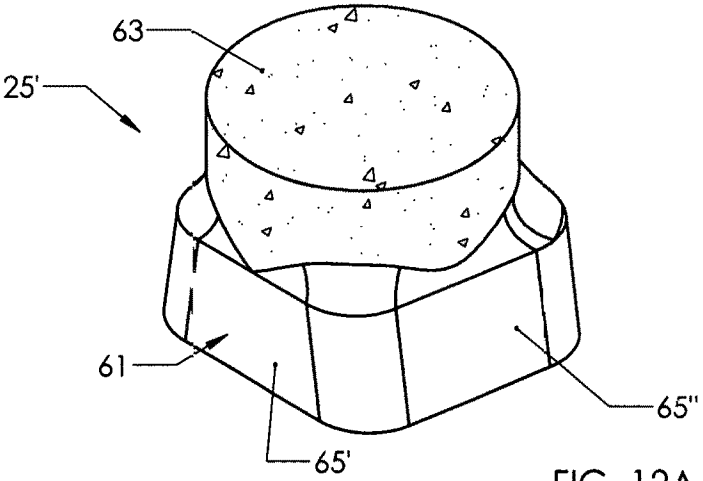
FIG. 12A is a perspective view of another embodiment of the construction of the grinding pad and wherein the metal attachment base has a different configuration than the one illustrated in FIGS. 8A and 8B.
Figure 12C:
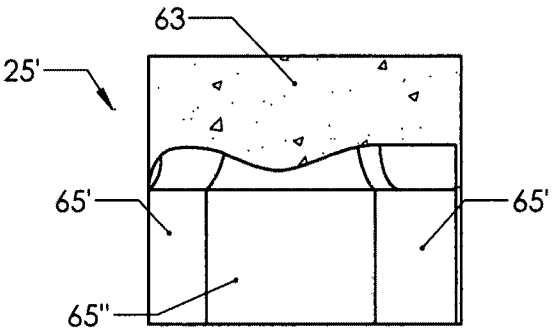
FIGS. 12B to 12D are top, front and rear views respectively of the grinding pad illustrated in FIG. 12A.
Figure 12B:
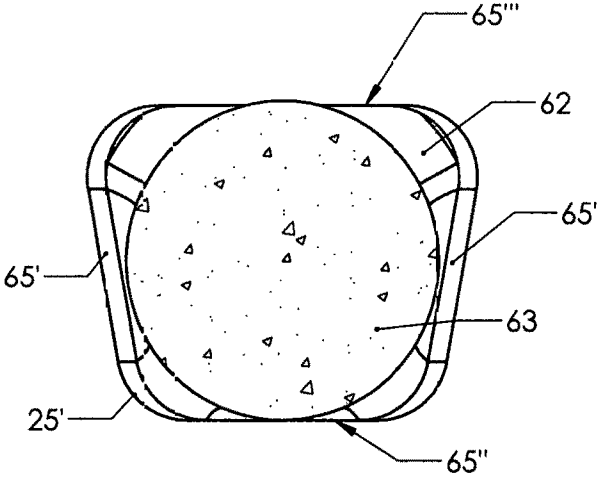
Figure 12D:
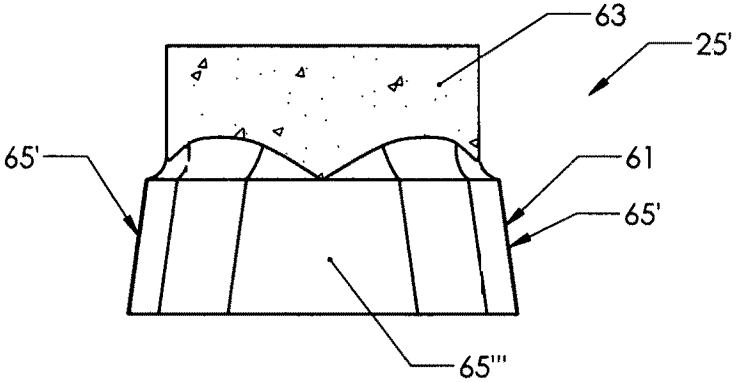
Figure 13A:
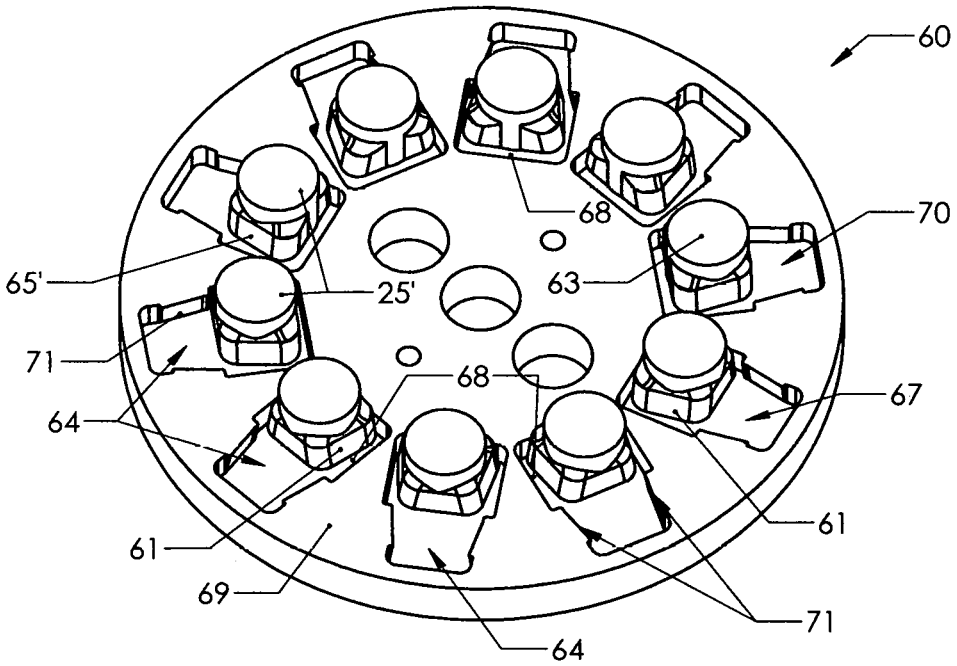
FIG. 13A is a perspective view of a still further embodiment of a single large grinding disc in which is formed a plurality of open-top-end engaging cavities for receiving in sliding friction fit the grinding pad as illustrated in FIG. 12A and wherein a plurality of the grinding pads are shown in their loaded position prior to be engaged at their engaged position.
Figure 13B:
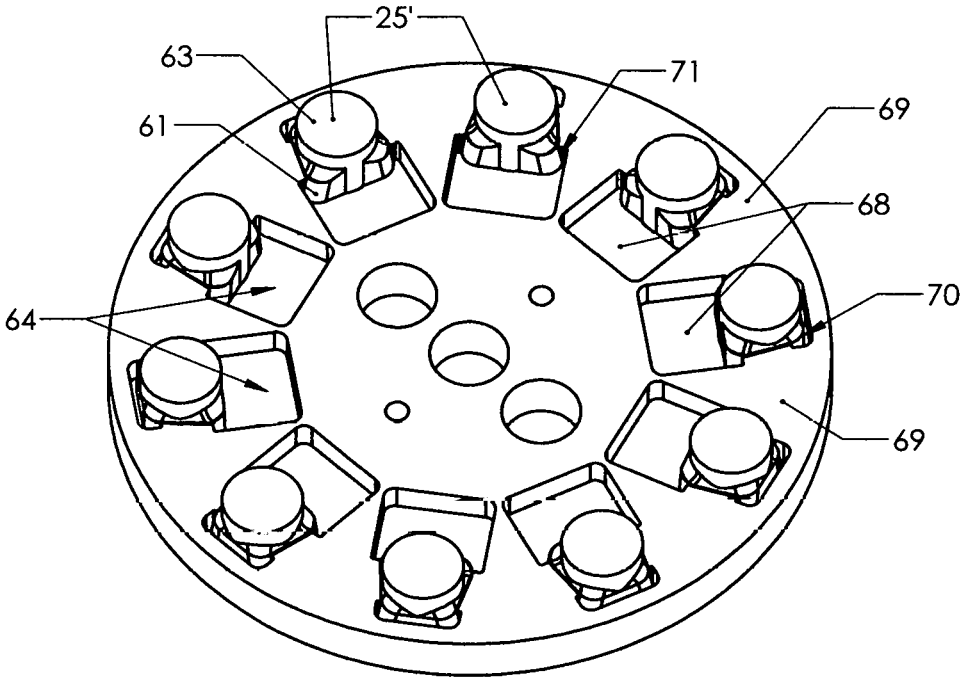
FIG. 13B is a perspective view similar to FIG. 13A showing the grinding pads at their engaged position in the cavities.

With reference now to FIGS. 12A to 13B there will be described a still further example of the pressure-fit grinding pad assembly of the present invention for removal securement in a high speed rotatable grinding disc 60, as illustrated in FIGS. 13A and 13B. With this particular embodiment, the grinding pad 25' has a different construction in that its mounting base 61 is formed with connecting formations which, as herein shown with a circular shaped head 63, projects outwardly from the circumference of the abrasion head 63 to define engagement means for securing the grinding pad 25' in attachment means constituted by grinding pad engaging cavities 64 formed in an outer surface 65 of the grinding disc 60.

The grinding pad 25' mounting base 61 is formed with tapered side walls 65 and as shown in FIG. 12B two of the opposed sidewalls, namely side walls 65' converge in a common direction to form a wedge shaped mounting base 61. The side walls 65' also slope outwardly downwards. The front and rear side walls 65" and 65''' are straight side walls. The bottom surface 66 is a flat bottom surface for sliding engagement on a flat bottom wall 67 of the cavities 64. Although the abrasion head 63 is herein shown as a circular disc shape head, it can have other shapes as mentioned herein above.

With reference to FIGS. 13A and 13B, it can be seen that grinding pad engaging cavities 64 are open-top-end cavities disposed equidistantly spaced all along a circumferential outer surface of the grinding disc 60. Each cavity 64 define a grinding pad receiving end section 68 for receiving the mounting base 61 of the grinding pad 25' therein. The cavities 64 have a depth substantially equal to the thickness of the mounting base 61 of the grinding pad 25' whereby the grinding pad abrasion head 63 projects above the outer surface 69 of the grinding disc 60. The cavities 64 also define a grinding pad engaging section 70. These grinding pad engaging sections 70 are formed with tapering side walls 71 to define a wedging section complimentary to the wedge shape mounting base 61 of the grinding pad 25'. These side wall 71 also taper inwards from the outer surface 69 of the grinding disc 60 to the flat bottom wall 67 of the cavities 64 and at a sloping angle which is the same as that of the opposed side wells 65' of the wedge shaped mounting base 61 of the grinding pad 25'.

The grinding pad 25' is engaged within the cavities 64 by simply inserting the mounting base 61 of the grinding pad 25' into the grinding pad receiving end section 68 of the cavity 64 which is larger than the circumference shape of the mounting base 61 and to slide the grinding pad 25' into the grinding pad engaging section 70 until the opposed wedge shaped side walls 65' of the mounting base are in frictional engagement with the undercut wedging tapered side walls 71 of the grinding pad engaging section 70. There is sufficient frictional engagement of the grinding pads 25' within the cavity engaging sections 70 to permit manipulation of the grinding disc 60 to be installed under the head assembly 11 of the floor grinding machine 10. Of course, during use of the machine when the grinding disc 60 is placed into rotation and the centrifugal force produced by the rotating grinding disc will apply a pushing force on the grinding pads 25' to wedge the grinding pads 25' firmly within their grinding pad engaging sections 70 of the cavities. Although, FIGS. 13A and 13B illustrate grinding pads installed in all of the cavities 64, there may be less grinding pads equidistantly mounted in only selected ones of the cavities.

Figure 14A:
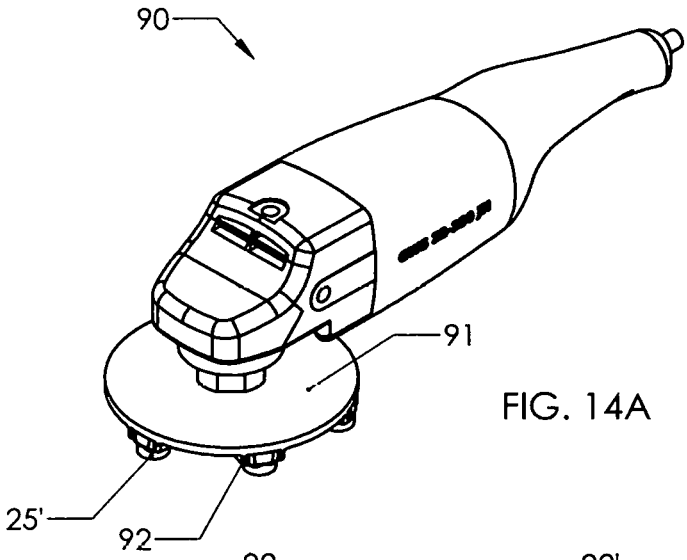
FIG. 14A is a perspective view of another type of grinding machine, herein a hand-held type grinder, capable of being fitted with small grinding discs equipped with pressure-fit grinding pads of the present invention.
Figure 14B:
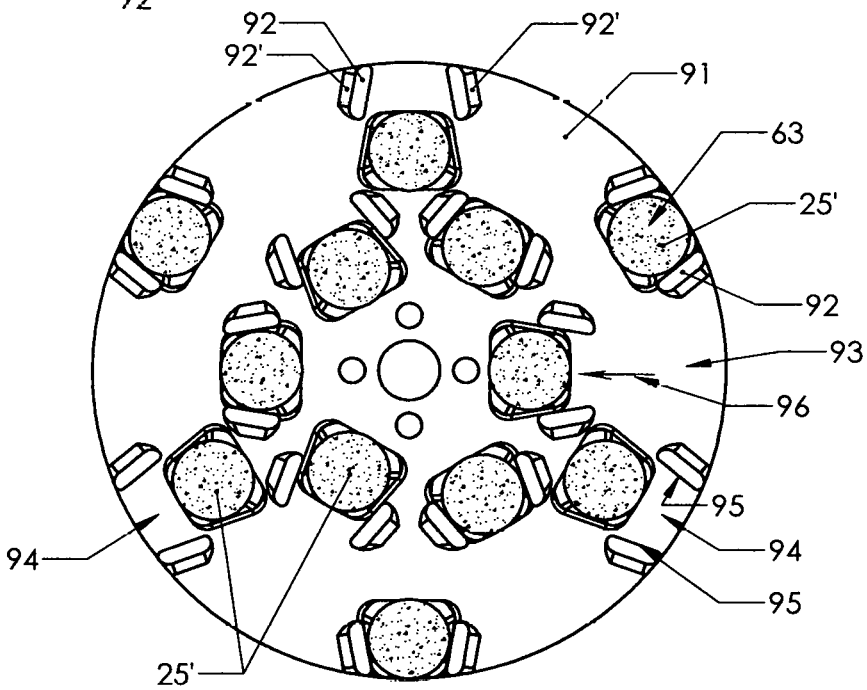
FIG. 14B is a top view of the grinding disc illustrating the grinding pad assembly using the combination of modified retainers of FIG. 8A, herein formed in the top surface of the disc, for use with the grinding pads of FIGS. 12A to 12D.
Figure 14C:
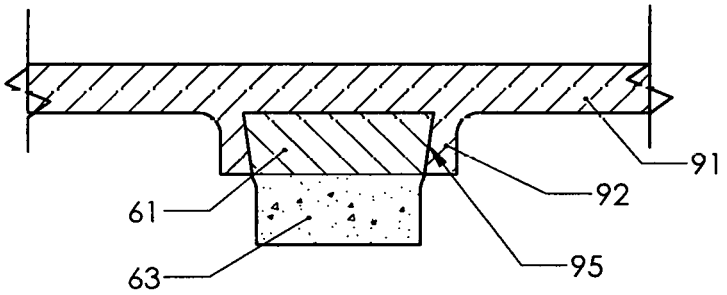
FIG. 14C is a cross-sectional view illustrating a grinding pad secured between the clamping ridges formed and projecting from the outer surface of the grinding disc.

Referring now to FIG. 14A there is shown another type of grinding machine, herein a hand-held grinder 90 in which there is housed an electric motor and gearing to impart rotation to a small grinding disc 91. As shown in FIGS. 14B and 14C, the disc 91 is provided with grinding pad engaging means in the form of pairs of clamping ridges 92 which are formed in the outer surface 93 of the disc 91 by a machining process. Each pair of clamping ridges 92 is comprised by spaced apart ridge formations 92' which are spaced apart a predetermined distance and shaped to define there between a wedge shape opening 94 with opposed side walls 95 of the pair of clamping ridges 92' being inwardly inclined as shown in FIG. 14C to receive in frictional pressure-fit there between the tapered and sloping side walls 65' of the grinding pad 25' as illustrated in FIGS. 12A-12D. These pads 25' are pressed into the wedge shape opening with sufficient force when assembling the disc 91 with grinding pads 25' and during use, the pads are maintained forceably between their pair of clamping ridges 92 by the centrifugal force developed by the rotating disc 91. To remove the grinding pads 25' after their abrasion head 63 is worn, it is necessary to punch out the mounting base 61 by applying a sufficient punching force of at least 250 psi in the direction of arrow 96 as shown in FIG. 14B. Has herein shown, there are pairs of clamping ridges 92 spaced-apart along an outer circumferential axis of the disc and also about an inner circular concentric axis.

The examples of the preferred embodiment described herein above provide a simple method of constructing a grinding disc for use in a floor grinding machine or hand-held grinder and which can be briefly summarized as follows. A grinding pad is formed by immovably bonding, by suitable means such as braising, an abrasion head of abrasion material to a metal attachment base which as described herein is a steel base. The so form grinding pad is then pressure fit connected to a metal attachment base by a coupling means associated with the grinding disc. The pressure-fit connection is performed in a press exerting sufficient pressure to prevent ease of removal of the attachment base from the coupling means and wherein the attachment base can be removed from the coupling means only by applying a punching force sufficient to eject the attachment base of the grinding pad from the coupling means.

In one of its aspects, the coupling means is a metal mounting base and the method comprises boring through holes in the mounting base to receive the attachment base of the grinding pad in pressure fit therein. The through holes may be formed with a slight taper as well as forming the attachment base with a suitable similar taper to facilitate the press-fit connection. When the abrasion head is worn after use, the remaining attachment base in the through hole is removed by pressure punching the attachment base with sufficient force to remove it from the hole. A new grinding pad can now be installed in the vacated bore by the use of a press. It is pointed out that the boring of through holes into the steel mounting base can be accomplished by several boring means to configure the hole to produce a frictional fit connection with the attachment base of the pads.

In another aspect the method comprises forming the attachment base with a wedge shaped form wherein the attachment base with the grinding pad is secured to a grinding disc by wedge retention means with the grinding disc and making it easy to remove the attachment plate with the wedge retention means. The wedge retention means can be formed by spaced retainer plates secured to the top surface of the grinding disc or by retention cavities formed about the grinding disc In a further aspect, the method comprises boring one or more through holes in a grinding disc along circular axes of the disc and connecting the grinding pads in selected ones of the through holes by pressure-fit securing the attachment base of the grinding pads in the through holes. The grinding disc is of course removably secured in the grinding head assembly of the floor grinding machine.

Figure 15A:
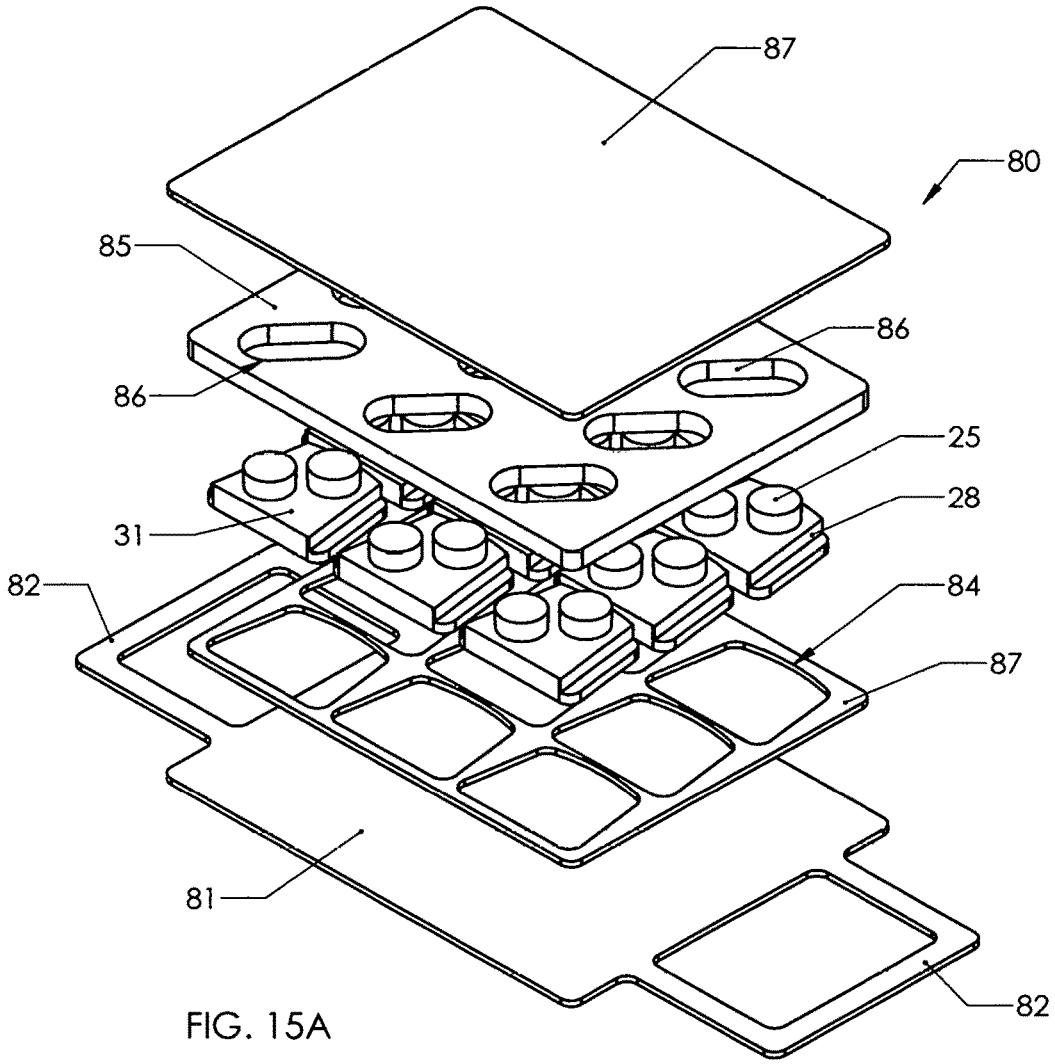
FIG. 15A is an exploded perspective view of the press component assembly for forming a plurality of grinding pad assemblies as illustrated in FIG. 7 and in a single press stroke operation.
Figure 15B:
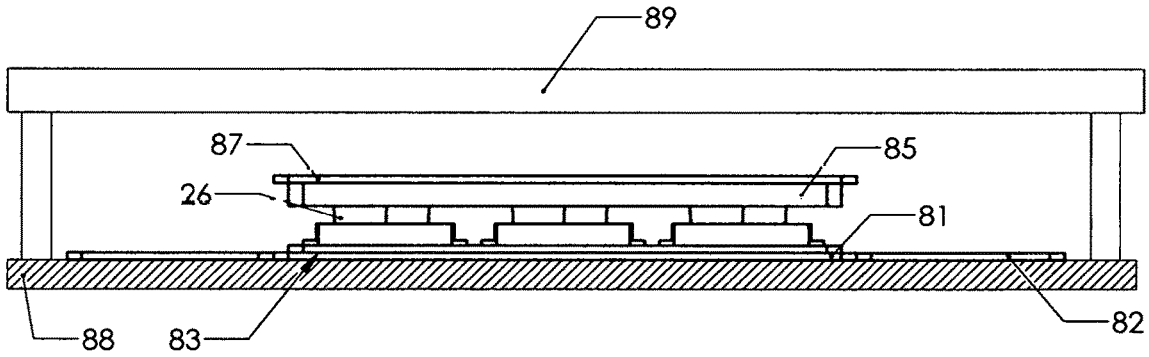
FIG. 15B is a side view showing the press component assembly in an assembled condition prior to be placed in a press for engaging the grinding pads in their respective mounting base.

Referring now to FIGS. 15A and 15B, there is shown generally at 80 a grinding pad component assembly for forming a plurality of grinding pads on a press, not shown but obvious. The components of the assembly comprises a support tray 81 formed by a steel plate formed with support handles 82 at opposed ends thereof to transport the component assemble and position it into and out of a press. On the support tray 81 there is positioned a mounting plate template 83 having a plurality of cut-outs 84 shaped to the contour of the mounting base 28, has herein illustrated there are nine of such cut-outs to receive therein, at precise locations, nine mounting bases 28 on each of which has been positioned into the top end of their respective through bores two grinding pads 25. A spacer plate 85 formed with a plurality of oblong shaped bores 86 is then positioned over the assembly of mounting bases with the grinding pads 25 top portion extending through the oblong bores 86. The thickness of the spacer plate 85 is the same as the thickness of the abrasion head 26 of the pads 25. A flat top steel plate 87 is then placed over the top ends of the grinding pads 25 and the component assembly is now completed and ready to be placed on a support platform 88 of a press, see FIG. 15B, where a top press plate 89 is actuated to apply a downward pressure on the component assembly until the top steel plate 87 is arrested on the top surface 90 of the spacer plate 85 causing all of the attachment bases 27 of the grinding pads 25 to be pressure fitted in their respective through bores 29 and the abrasion heads 26 all projecting above the top surface 31 of their respective mounting base 21. Accordingly, as can be seen a plurality of pressure fit grinding pad assembly can be manufactured in a very short period of time and in a safer manner than with the prior art assembly as discussed herein above.

It within the ambit of the present invention to encompass all obvious modifications of the examples of the preferred embodiment described herein provided such modifications fall within the scope of the appended claims. As examples only, the through bores could consist of holes formed in the top surface of the mounting base and extending partly within the base and with a small hole drilled in a bottom wall of the hole for the escape of air to permit the pressure-fit connection of the attachment base of the grinding pad within the hole. Also, the attachment base of the grinding pad can be formed with a variety of connecting means, such as flanges, tapers, slots in opposed side walls, etc., wherein to secure to a complimentary connection means formed with or secured to the grinding disc outer surface. As previously mentioned the abrasion head to the grinding pad can have several shapes and formed of different grits and grinding particles. Also, the attachment base of the grinding pad can be removed from its pressure-fit connection in the holes of the metal attachment base or disc by de-pressing in a press or by punching the attachment base with an instrument to which a suitable punching force can be applied, and as an example, by the use of a steel punch and hammer. It is further pointed out that the cross-sectional shape of the pad attachment base and the through bores can have a variety of complimentary shapes.

The invention claimed is:

1. A pressure-fit grinding pad assembly for removable retention in a motor driven grinding disc outer surface of a floor grinding machine for grinding surfaces containing hard material particles, said pressure fit grinding pad assembly comprising a re-usable mounting base formed from a solid metal plate of predetermined thickness having one or more through bores extending from a top surface of said mounting base to a bottom surface thereof, each said through bores having an inner surface of defined cross-section shape extending between said top surface to said bottom surface, and a grinding pad formed by an abrasion head of abrasion material immovably bonded on a metal attachment base formed by a solid mass of a thickness not greater than said predetermined thickness of said mounting base, said metal attaching base having a defined cross-sectional shape throughout and dimensioned for pressure fit frictional connection in said one or more through bores by only by the use of a press wherein said metal attachment base has a predetermined retention force value with said through bore and sufficient to prevent removal of said attachment base from its pressure fit connection without the use of pressure punching said attachment base from said through bore with a force of about 250 psi or more sufficient to overcome said retention force value of said metal attachment base, said reusable mounting base being wedge shaped with opposed side surfaces each defining an attachment formation which is formed by an elongated lower retention ridge projecting therefrom and having a flat ledge top surface, said elongated retention ridge being configured to be clamped and immovably retained captive under a projecting flange formed on opposed sides of a wedge-shaped open top end cavity on said outer surface of said grinding disc by retainer plates secured spaced-apart on said outer surface of said grinding disc, said abrasion head projecting above said top surface of said re-usable mounting base.

2. The pressure-fit grinding pad assembly as claimed in claim 1 wherein said retainer plates define wedge-shaped open top end cavities there between with said outer face of said motor driven support disc, there being at least three of said retainer plates disposed spaced-apart about an outer circumference of said support disc to define three of said wedge-shaped open top end cavities to receive three of said mounting plates, said support disc being a circular support disc.

3. The pressure-fit grinding pad assembly as claimed in claim 2 wherein each of said three mounting plates has two of said grinding pads secured thereto, and wherein said abrasion material of said grinding heads has a specific grit count to provide a desired grounding surface and further wherein said mounting plates are interchangeable with other mounting plates provided with grinding pads of different grit count.

4. The pressure-fit grinding pad assembly as claimed in claim 1 wherein said inner surface of said through bore is a tapered inner surface tapering inwards from said top surface to said bottom surface.

5. The pressure-fit grinding pad assembly as claimed in claim 4 wherein said metal attachment base has a slight conical taper tapering inwards to a bottom end thereof.

6. The pressure-fit grinding pad assembly as claimed in claim 1 wherein said grinding pad is a cylindrical grinding pad with said attachment base and said abrasion head having a common cross-sectional shape.

7. A pressure-fit grinding pad assembly for removable securement to a high speed rotatable grinding disc of a floor grinding machine, said pressure-fit grinding pad comprising an abrasion head bonded onto a mounting base engaging section having a flat bottom surface, said mounting base engaging section having a wedge-shape configuration defining opposed angularly tapered side walls converging in a common direction to form a wedge shape mounting base, said opposed angularly tapered side walls further sloping outwardly downwards and outwards from a top end on which said abrasion head is bonded to said flat bottom surface, said grinding disc being a circular flat grinding disc having a plurality of grinding pad engaging cavities means associated with an outer surface of said flat grinding disc and disposed spaced apart along a circumferential axis of said grinding disc, each said grinding pad engaging cavities being open-top-end cavities defining a grinding pad receiving end section which is larger than the circumference shape of said mounting base and a grinding pad engaging section for receiving in retention friction fit therein said mounting base of said grinding pad, said grinding pad engaging section of said cavities means defining retention slots having inwardly tapered side walls tapering inwardly from a top end of said grinding pad engaging cavities to a bottom end of said cavities for receiving in wedging friction fit therein said mounting base of said grinding pad and with said grinding pad abrasion head disposed above said outer surface of said grinding disc.

8. The pressure-fit grinding pad assembly as claimed in claim 7 wherein said plurality of grinding pad engaging cavities are formed on spaced circular axes of said circular flat disc, said mounting base engaging section having a wedge shape configuration defining opposed inwardly tapered side walls for clamping engagement with wedge shape attachments provided on opposed side surfaces of said grinding pad engaging section.

9. The pressure-fit grinding pad assembly as claimed in claim 7 wherein said receiving end section of said grinding pad engaging cavity is larger than the circumference of said mounting base of said grinding pad assembly to permit free top end entry of said grinding pad mounting base therein, said grinding pad being displaceable into frictional engagement into said engaging section and being further retained therein by friction between said angularly sloping wedge shape side walls surfaces of said grinding pad engaging section and said tapered side wall of said mounting base and by centrifugal force exerted thereon by the rotational speed of said circular flat disc when placed in rotation by said motor.

10. The grinding pad as claimed in claim 7 wherein said grinding pad engaging means is comprised by pairs of clamping ridges formed and spaced about said outer surface of said grinding disc and projecting there above, each ridge of said pair of clamping ridges being spaced apart and shaped to define there between a wedge shape clamping passage with opposed side walls of said pair of ridges being inwardly tapered to receive there between in frictional pressure retention opposed side walls of said mounting base of said grinding pad, said opposed side walls being tapered side walls.

11. A method of constructing a grinding disc for use with a floor grinding machine, said method comprising the steps of:

i) forming a grinding pad immovably bonding an abrasion head formed of abrasion material to a metal attachment base of predetermined thickness and formed by a solid metal mass, ii) forming a re-usable metal mounting plate of uniform thickness and wedge shaped, iii) forming attachment formations in opposed side surfaces of said mounting plate each defining an attachment formation which is formed by an elongated lower retention ridge projecting therefrom and having a flat ledge top surface, said elongated retention ridge being configured to be clamped and immovably retained captive under a projecting flange formed on opposed sides of a wedge-shaped open top end cavity on an outer surface of said grinding disc by retainer plates secured spaced-apart on said outer surface of said grinding disc, iv) boring one or more through bores of predetermined cross-section in said a reusable metal mounting base of predetermined thickness to receive said metal attachment base of said grinding pad in press-fit therein, said metal attachment base having a thickness not greater than said predetermined thickness of said metal mounting base, said metal mounting base having a flat top and bottom surface, v) a pressure-fit connecting said metal attachment base of said grinding pad in one of said one or more through bores by a press applying a wherein said metal attachment base has a predetermined retention force value of about 250 psi or more to impart to said attachment base a like retention force with said through bore and sufficient to prevent removal of said attachment base from its pressure fit connection, without and vi) removing said metal attachment base from said one of said one or more through bores after said abrasion head has worn by the use of pressure punching said attachment base from said through bore with a force of at least said predetermined retention force value to overcome the interconnection of said metal attachment base with said one of said one or more through bores in said metal mounting base.

12. The method as claimed in claim 11 wherein said step fit ill further comprises the steps of boring said through bores with a tapered inner surface to form a slight conical bore sloping inwardly form a top surface to a bottom surface of said metal mounting base, and wherein there is further provided forming said metal attachment base of said grinding pad with a slight conical taper complimentary to said tapered inner surface of said through bores.

13. A pressure-fit grinding pad for removable securement in a high speed rotatable and re-usable grinding disc of a floor grinding machine comprising a circular grinding disc of predetermined thickness and having a plurality of through bores extending from a top surface of said grinding disc to a bottom surface thereof, each said through bores having a common inner cross-sectional surface disposed between said top surface to said bottom surface, and a grinding pad formed by an abrasion head of abrasion material immovably bonded on a metal attachment base formed by a solid mass of a thickness not greater than said predetermined thickness of said grinding disc and having a defined cross-sectional outer surface; said attachment base being dimensioned for pressure fit frictional connection in one of said plurality of through bores by a press wherein said attachment base has a retention force value of about 250 psi or more with said through bore and sufficient to prevent removal of said attachment base from its pressure fit connection without the use of pressure punching said attachment base from said through bore with a force of about 250 psi or more to overcome said retention force; said abrasion head projecting above said top surface of said grinding disc, said grinding disc being provided with one or more connectors projecting from said bottom surface thereof for quick removable connection with a support member.

14. The pressure-fit grinding pad as claimed in claim 13 wherein said inner surface of said through bore has a slight tapered inner surface tapering inwards from said top surface to said bottom surface, said metal attachment base having a slight conical taper tapering inwards to a bottom end thereof.

15. The pressure-fit grinding pad as claimed in claim 13 wherein said plurality of through bores are disposed along at least one circumferential path of said grinding disc.

16. The pressure-fit grinding pad as claimed in claim 13 wherein said connectors are constituted by at least two spaced-apart elongated connector pins formed with an engaging head and configured for clamping engagement into spring connectors mounted in said support member.

17. The pressure-fit grinding pad as claimed in claim 16 wherein said support member is a circular support disc having a circumference substantially the same as that of said circular grinding disc, and a flat grinding disc stabilizing support plate secured to an outer face of said circular support disc between said connector pins for support engagement with said bottom surface of said grinding disc to maintain parallel support of said grinding disc with said support disc to prevent the transfer of shearing forces to said connector pins during rotational drive of said grinding disc by said floor grinding machine.

* * * * *